US011841178B1

(12) United States Patent
Saralkar et al.

(10) Patent No.: US 11,841,178 B1
(45) Date of Patent: Dec. 12, 2023

(54) SYSTEMS AND METHODS TO MANAGE POWER CONSUMPTION OF A BUILDING AND STORAGE BY CONTROLLING A REFRIGERATION SYSTEM WITHIN THE BUILDING

(71) Applicant: AXIOM CLOUD INC., San Jose, CA (US)

(72) Inventors: Nikhil Saralkar, Oakland, CA (US); Anthony Diamond, Bainbridge Island, WA (US); Amrit Robbins, Oakland, CA (US)

(73) Assignee: AXIOM CLOUD INC., San Jose, CA (US)

( * ) Notice: Subject to any disclaimer, the term of this patent is extended or adjusted under 35 U.S.C. 154(b) by 0 days.

(21) Appl. No.: 17/374,958

(22) Filed: Jul. 13, 2021

(51) Int. Cl.

| | |
|---|---|
| ***F25B 49/02*** | (2006.01) |
| ***F25B 41/20*** | (2021.01) |
| *F24F 140/60* | (2018.01) |
| *F24F 120/10* | (2018.01) |
| *F24F 140/50* | (2018.01) |

(52) U.S. Cl.
CPC ..... *F25B 49/022* (2013.01); *F25B 41/20* (2021.01); *F24F 2120/10* (2018.01); *F24F 2140/50* (2018.01); *F24F 2140/60* (2018.01); *F25B 2600/026* (2013.01); *F25B 2600/0251* (2013.01); *F25B 2700/15* (2013.01); *F25B 2700/2104* (2013.01); *F25B 2700/2106* (2013.01)

(58) Field of Classification Search
CPC ..... F24F 2120/10; F24F 2140/00; F24F 2140/50; F24F 2140/60; H02J 3/28
USPC ..... 700/295, 296
See application file for complete search history.

(56) References Cited

U.S. PATENT DOCUMENTS 3,872,688 A * 3/1975 Tillman ..... F25D 23/069 62/291
4,807,443 A 2/1989 Battson
(Continued)

FOREIGN PATENT DOCUMENTS

CA 2509493 C 8/2016
WO 1999024771 A1 5/1999
(Continued)

*Primary Examiner* — Jerry-Daryl Fletcher
*Assistant Examiner* — Daniel C Comings

(57) ABSTRACT

Systems and methods to manage power consumption of a building and storage by controlling a refrigeration system within the building are disclosed. Exemplary implementations may: receive input defining an average power target and a time interval; determine system information characterizing a refrigeration system; determine build information characterizing power usage of a building that includes the refrigeration system; determine precooling control actions based on the system information, the average power target, and the time interval; determine load shedding control actions based on the system information, the average power target, and the time interval; generate a control schedule for the refrigeration system to effectuate the precooling control actions and/or load shedding control actions based on the average power target, the time interval, and the building information; and effectuate the precooling control actions and/or load shedding control actions for the refrigeration system in accordance with the control schedule.

10 Claims, 3 Drawing Sheets

(56) References Cited

U.S. PATENT DOCUMENTS

| | | | | |
|---|---|---|---|---|
| 5,586,444 | A | 12/1996 | Fung | |
| 7,617,695 | B2 | 11/2009 | Shapiro | |
| 8,280,556 | B2 | 10/2012 | Besore | |
| 8,869,546 | B2 | 10/2014 | Besore | |
| 9,599,118 | B2 | 3/2017 | Zhou | |
| 10,190,793 | B2 | 1/2019 | Drees | |
| 10,323,878 | B1 | 6/2019 | Woolf | |
| 10,558,937 | B1 | 2/2020 | Wolf | |
| 10,580,094 | B1 * | 3/2020 | Haynold | G06Q 50/06 |
| 10,674,638 | B2 * | 6/2020 | Bailey | F25B 49/022 |
| 10,876,754 | B2 | 12/2020 | Wenzel | |
| 2003/0177776 | A1 | 9/2003 | Ghent | |
| 2010/0289643 | A1 * | 11/2010 | Trundle | F24F 11/47 340/3.1 |
| 2011/0153090 | A1 | 6/2011 | Besore | |
| 2012/0023987 | A1 | 2/2012 | Besore | |
| 2012/0296711 | A1 | 11/2012 | Huffman | |
| 2013/0145781 | A1 | 6/2013 | Liu | |
| 2015/0316297 | A1 | 11/2015 | Prins | |
| 2017/0067661 | A1 * | 3/2017 | Barajas Gonzalez | G05B 15/02 |
| 2017/0241690 | A1 | 8/2017 | Groshek | |
| 2019/0079473 | A1 | 3/2019 | Kumar | |
| 2019/0235556 | A1 | 8/2019 | Elbsat | |
| 2019/0338977 | A1 | 11/2019 | Turney | |
| 2020/0136504 | A1 * | 4/2020 | Schumacher | B60H 1/00428 |

FOREIGN PATENT DOCUMENTS

| | | | |
|---|---|---|---|
| WO | 2014124353 | A1 | 8/2014 |
| WO | 2018200861 | A1 | 11/2018 |

* cited by examiner

SYSTEMS AND METHODS TO MANAGE POWER CONSUMPTION OF A BUILDING AND STORAGE BY CONTROLLING A REFRIGERATION SYSTEM WITHIN THE BUILDING

FIELD OF THE DISCLOSURE

The present disclosure relates to systems and methods to manage power consumption of a building and storage by controlling a refrigeration system within the building.

BACKGROUND

Typically, mass refrigeration systems (e.g., warehouses, supermarkets) utilize electrochemical batteries to offset electrical consumption. However, the amount of power required from the electrochemical batteries may be costly given the large amount of power consumed by the mass refrigeration systems.

SUMMARY

One aspect of the present disclosure relates to optimizing power consumption of a building by instructing a refrigeration system within the building to precool items enclosed within the refrigeration system and load shed. The precooling and the load shedding may occur based on a desired power target for a particular time interval. The desired power target and the time interval may be obtained via user input (e.g., manager of the refrigeration system) or obtained from an external resource. Based on the power target and the time interval obtained and information related to the refrigeration system obtained, precooling and the load shedding control actions may be determined. Subsequently, and a control schedule to effectuate the precooling and the load shedding may be generated based on the power target, the time interval, and information related to the building, and subsequently executed. As such, the building may optimize power consumption and more efficiently store power through excess refrigeration capacity and thermal capacity of the items being refrigerated in addition to operational flexibility of the mass refrigeration systems. As a result, demand charges may be reduced.

One aspect of the present disclosure relates to a system configured to manage power consumption of a building and storage by controlling a refrigeration system within the building. The system may include one or more hardware processors configured by machine-readable instructions. The machine-readable instructions may include one or more instruction components. The instruction components may include computer program components. The instruction components may include one or more of input receiving component, system information determination component, building information determination component, control action determination component, control component, and/or other instruction components.

The input receiving component may be configured to receive input defining an average power target and a time interval. The average power target may be for the time interval. The average power target may be an optimal amount of power consumption or usage of the building during the time interval.

The system information determination component may be configured to determine system information characterizing a refrigeration system. The system information may include suction pressures, compressor information, case information, circuit control information, defrost schedules, door information, pressure information, and/or other system information.

The building information determination component may be configured to determine building information characterizing power usage of a building that includes the refrigeration system. The building information may include current power information, a required power target based on the average power target and the current power information, a building temperature, and/or other building information.

The control action determination component may be configured to determine precooling control actions based on the system information, the average power target, the time interval, and/or other information. The control action determination component may be configured to determine load shedding control actions based on the system information, the average power target, the time interval, and/or other information.

The control component may be configured to generate a control schedule for the refrigeration system to effectuate the precooling control actions and/or load shedding control actions based on the average power target, the time interval, the building information, and/or other information. The precooling may control actions and load shedding control actions facilitate acquisition of electrical power or distribution of the electrical power. The control component may be configured to effectuate the precooling control actions and/or load shedding control actions for the refrigeration system in accordance with the control schedule.

As used herein, the term "obtain" (and derivatives thereof) may include active and/or passive retrieval, determination, derivation, transfer, upload, download, submission, and/or exchange of information, and/or any combination thereof. As used herein, the term "effectuate" (and derivatives thereof) may include active and/or passive causation of any effect, both local and remote. As used herein, the term "determine" (and derivatives thereof) may include measure, calculate, compute, estimate, approximate, generate, and/or otherwise derive, and/or any combination thereof.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

DETAILED DESCRIPTION

Figure 1:
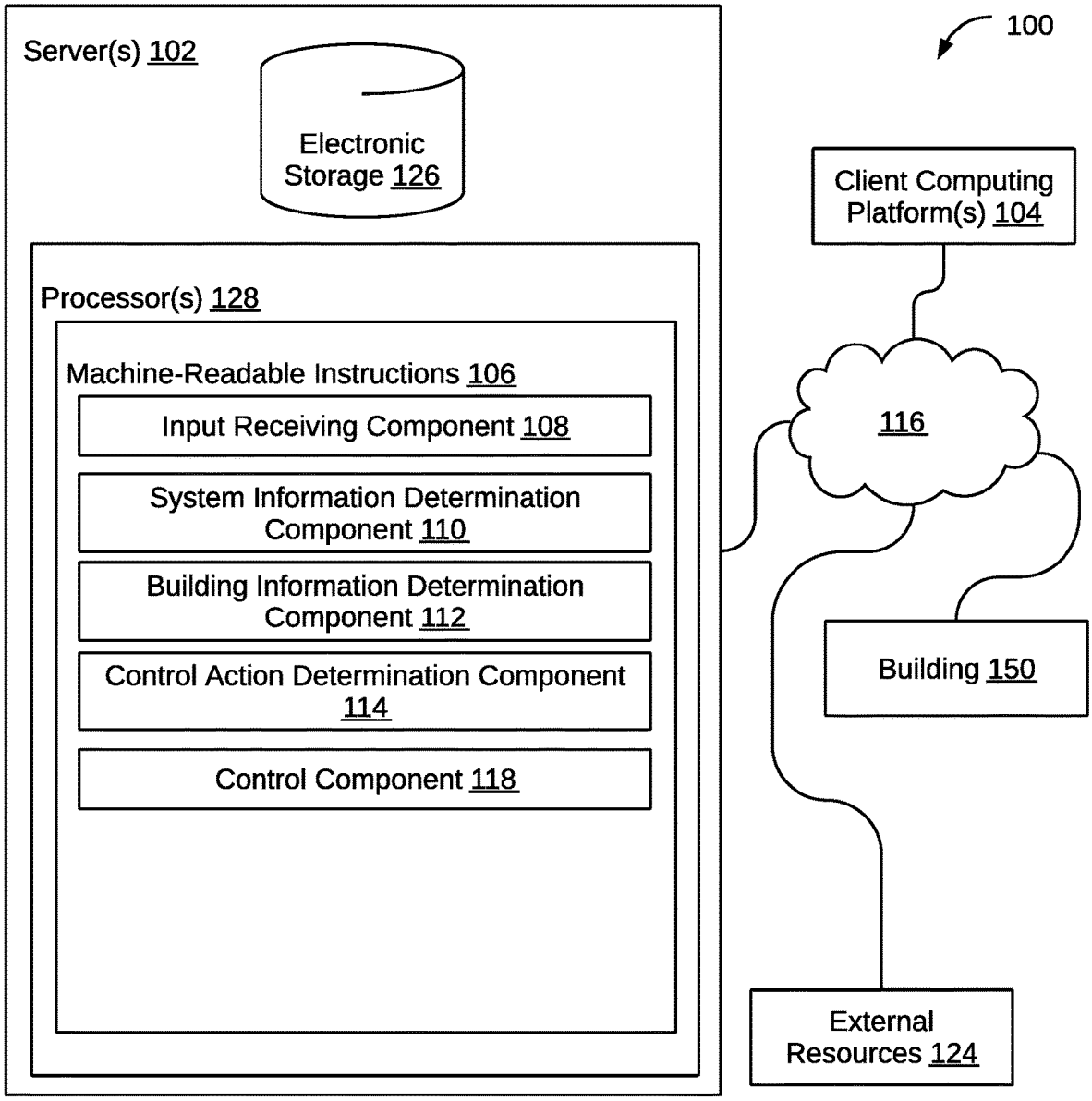
FIG. 1 illustrates a system configured to manage power consumption of a building and storage by controlling a refrigeration system within the building, in accordance with one or more implementations.

FIG. 1 illustrates a system 100 configured to manage power consumption of a building and storage by controlling a refrigeration system within a building 150, in accordance with one or more implementations. In some implementations, system 100 may include one or more servers 102. Server(s) 102 may be configured to communicate with one or more client computing platforms 104 according to a client/server architecture and/or other architectures. Client computing platform(s) 104 may be configured to communicate with other client computing platforms via server(s) 102 and/or according to a peer-to-peer architecture and/or other architectures. Users may access system 100 via client computing platform(s) 104. A given client computing platform 104 may be associated with, connected via a network 116, and/or operatively linked via one or more electronic communication links with building 150, the refrigeration system, and/or other systems within building 150 such that facility operations, the refrigeration system, and/or the other systems may be controlled and/or monitored via client computing platform 104. In some implementations, the refrigeration system may be operatively linked with building 150 and/or wirelessly connected with building 150 via network 116.

Server(s) 102 may be configured by machine-readable instructions 106. Machine-readable instructions 106 may include one or more instruction components. The instruction components may include computer program components. The instruction components may include one or more of input receiving component 108, system information determination component 110, building information determination component 112, control action determination component 114, control component 118, and/or other instruction components.

Input receiving component 108 may be configured to receive input defining an average power target and a time interval. The average power target may refer to an ideal power consumption of building 150 to achieve for or during the time interval. The time interval may be an amount of seconds, an amount of minutes, an amount of hours, an amount of days on a particular date and/or time. In some implementations, the time interval may a time between be a start time and an end time. For example, the time interval may be between 2:00 PM and 2:15 PM (i.e., a 15-minute time interval). In some implementations, the average power target may be determined and received from external resource(s) 124. In some implementations, the average power target may be received via the input enter by a user (e.g., a manager of building 150).

System information determination component 110 may be configured to determine system information characterizing the refrigeration system. The refrigeration system may be configured to cool, maintain coldness, freeze, and/or keep frozen products stored within one or more cases of the refrigeration system. In some implementations, all the cases of an individual refrigeration system may cool and/or maintain the coldness of the products stored within. In some implementations, all the cases of an individual refrigeration system may freeze and/or keep frozen of the products stored within. In some implementations, some the cases of an individual refrigeration system may cool and/or maintain the coldness of the products stored within, and some of the cases may freeze and/or keep frozen of the products stored within. The system information may include suction pressures at various times, compressor information, case information, circuit control information, defrost schedules, door information, pressure information, historical facility operations, and/or other system information. In some implementations, some or all of the system information may vary for the individual cases included in the refrigeration system.

The compressor information may include current states of individual compressors, historical states of the individual compressors, and/or other compressor information. States of the individual compressors (current and historical) may include a compressor type, run capacity of the individual compressor, run time at the run capacity, and/or other compressor information.

The case information may include current case temperatures of the individual cases included in the refrigeration system, historical case temperatures of the individual cases, case types, and/or other case information. A case may refer to a container that stores the products requiring cooling or freezing. For example, the products may include produce, dairy products, meats, among others. The case temperatures, current and historical, may be in Celsius, Fahrenheit, or both. The case types may include a forced air case, a gravity coil case, and/or other case types. The individual cases of the refrigeration system may include different access to the products stored inside. For example, the different access may include one or more of a front door access, a rear door access, a partially open front access, an open front access, an open rear access, a top door access, a side door access, and/or other access to the products by consumers and/or employees (e.g., product stockers). The different accesses may affect the case temperatures, functionality of the individual case types, other case information, and/or other system information of the refrigeration system.

The circuit control information may include current positions of individual circuit control valves, historical positions of the individual circuit control valves, and/or other information. The positions of the individual circuit control values may control a flow rate of a particular fluid and thus control the case temperature of the corresponding cases, pressure of the particular fluid, a level of the particular fluid, and/or other parameter values related to the refrigeration system.

The defrost schedules may characterize a schedule for defrosting the products in the individual cases. The defrost schedules may include one or more dates and/or times at which the case temperatures are set to particular temperatures to gradually progress the case temperatures to a target case temperature. In some implementations, the dates, the times, the particular temperatures, and the target case temperature may be based on user input. In some implementations, the user input may include a target time at which the products should be a target temperature or the target case temperature for a target time. Based on such, the dates, the times, and the particular temperatures may be determined by system information determination component 110. In some implementations, the defrost schedules may be determined and obtained from external resource(s) 124. In some implementations, the individual cases may function in accordance with individual defrost schedules. In some implementations, multiple or all cases may function in accordance with a single defrost schedule.

The door information may include a date, time, and/or duration at which one or more doors of the individual cases are open and closed. In some implementations, the door information may include an operator who has opened or closed the door at a particular date and/or time. For example, the operator may be a maintenance worker for the refrigeration system, an employee that utilized the refrigeration system (e.g., product stocker, butcher, baker, manager of building 150 that includes the refrigeration system, etc.), a customer, and/or other operators. In some implementations, the door information may be conveyed by one or more door sensors on the individual cases.

The pressure information may include a condenser pressure at which refrigerant changes from a gas to a liquid, a compressor discharge pressure, an evaporator pressure at which the refrigerant changes from a liquid to a gas, and/or other pressure information. In some implementations, the pressure information may be for the individual cases or for the refrigeration system as a whole.

The historical facility operations may include restocking schedules, work hours, clearance schedules, operational information of other systems included in building 150, and/or other information. The restocking schedules may include dates and/or times at which the products in all the cases or the individual cases are restocked with other or new products. The work hours may include time periods at which building 150 or individual systems within building 150 (e.g., the refrigeration system) are operated by the operators. The clearance schedules may be dates and/or times at which some or all of the products are cleared from all or individual cases. The other systems included in building 150 may include one or more of a trash compactor, cooking equipment (e.g., mixers, ovens, dish washers, etc.), an elevator, a heating system, a ventilation system, an air conditioning system, a lighting system, a security system (e.g., surveillance systems, alarm systems), an intercom system, and/or other systems. The operational information for the other systems may include operation schedules indicating when the individual other systems are active, inactive, or idle, managers of the individual other systems, historical maintenance of the individual other systems, date of installation, warranty information for the individual other systems, and/or other operational information.

Building information determination component 112 may be configured to determine building information characterizing power usage of building 150 that includes the refrigeration system and/or the other systems. The power usage may refer to an amount of energy used per unit of time. The building information may include current power information, a required power target, a building temperature, and/or other building information.

The current power information may indicate current power that building 150 is consuming. In some implementations, the current power information may be obtained from an electrical meter coupled with building 150. In some implementations, the current amount of power may be calculated per unit of time based on a regression model, a time of a day, the day of the week, an occupancy value, an outside air temperature value, and/or other information. For example, the regression models may include linear regression, logistic regression, ridge regression, lasso regression, polynomial regression, Bayesian linear regression, and/or other regression model. In some implementations, the regression model may be based on the historical facility operations. The unit of time may be seconds, minutes, hours, and/or other unit of time. The occupancy may refer to used space of building 150 or particular areas thereof with people, animals, the systems, and/or the products. The occupancy value may be in cubic feet, cubic meters, a particular amount of the people, a particular amount of the animals, a particular amount of the systems, a particular amount of the products, and/or other unit of occupancy. The outside air temperature value may be obtained from external resources 124. The outside air temperature value may be conveyed by and obtained from one or more temperature sensors associated or coupled with building 150.

The required power target may be power required by building 150. The required power target may be based on the average power target, the current power information, the building information and/or other information. In some implementations, the required power target may be determined by building information determination component 112. In some implementations, the required power target may be determined by external resources 124 and received by building information determination component 112. The building temperature may include an average building temperature of the entire building, temperatures of individual areas of building 150, a temperature at which building 150 is set at, temperatures at which the individual areas are set at, and/or other building temperatures.

Control action determination component 114 may be configured to determine precooling control actions based on the system information, the average power target, the time interval, and/or other information. The precooling control actions may include increasing an amount of active compressors within the refrigeration system, increasing the active compressors, deactivating one or more unloaders of the compressors, increasing frequency of variable frequency drives, controlling circuit control valves connected to evaporators, and/or other precooling control actions. In some implementations, a particular amount of compressors may be included in the refrigeration system. Some or all of the compressors may be active at once. Increasing the amount of active compressors may include activating one or more of the compressors not already active. Increasing the active compressors may include lowering a trigger temperature (of temperature sensors associated with the compressors and/or within the cases of the refrigeration system) that actives the compressors, increasing a motor speed of the compressor, and/or other operations to increase the active compressors. Controlling the circuit control valves may include opening or closing the circuit control valves partially or completely on all the evaporators or some of the evaporators. The circuit control valves may be partially opened or closed by a rotational degree, a flow rate amount, and/or other value.

Control action determination component 114 may be configured to determine load shedding control actions based on the system information, the average power target, the time interval, and/or other information. The load shedding control actions may include decreasing the amount of the active compressors (i.e., the opposite of increasing the amount of the active compressors described herein), decreasing the active compressors, activating the unloaders, decreasing frequency of variable frequency drives, and/or other load shedding control actions.

Control component 118 may be configured to generate a control schedule for the refrigeration system to effectuate the precooling control actions and/or load shedding control actions. The precooling control actions and the load shedding control actions may facilitate acquisition of electrical power or distribution of the electrical power. The control schedule may be generated in accordance with a generation plan. The generation plan may specify that the control schedule is generated recurring after a particular amount of time (e.g., every 5 days, every 30 days), periodically (e.g., first day of every month, every Monday, etc.), responsive to user input to generate, and/or at other times. The generation plan may specify that a remainder of the control schedule is updated at particular times or periodically based on the building information, the system information, and/or other information. For example, the control schedule may be updated upon half the amount time between the times at which the control schedules are generated at lapsed (e.g., 15 days into the 30 days).

Control component 118 may be configured to effectuate the precooling control actions and/or load shedding control actions for the refrigeration system in accordance with the control schedule. In some implementations, the control schedule may be effectuated immediately subsequent to the generation. In some implementations, the control schedule may be transmitted to a different component, building 150, or the refrigeration system for effectuation. Responsive to the effectuation of the control schedule, power consumption by the refrigeration system and/or the building may be reduced. Reduction of the power consumption, particularly during individual time intervals, may reduce demand charges. An electrical power demand may be based on a highest average amount of energy consumed during a particular time interval by the building (i.e., customer). The electrical power demand may be a larger portion of an electricity bill, billed at a higher rate, and/or other differences that may add expense to a manager/management of the building, i.e., the demand charges.

Figure 3:
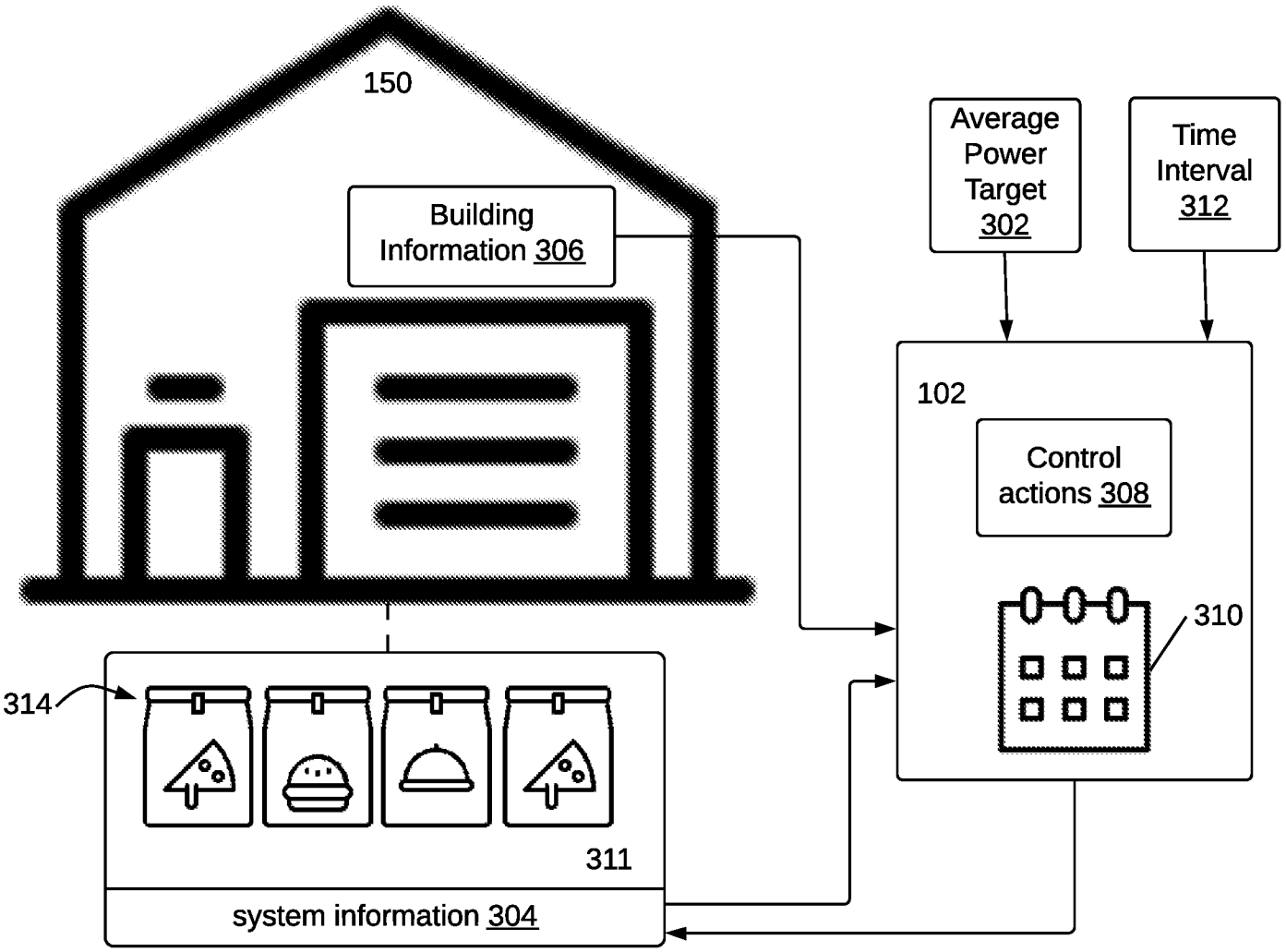
FIG. 3 illustrates an example implementation of the system configured to manage power consumption of a building and storage by controlling a refrigeration system within the building, in accordance with one or more implementations.

FIG. 3 illustrates an example implementation of building 150 (the same as or similar in FIG. 1) that include a refrigeration system 311. Building 150 may include building information 306 as detailed in FIG. 1. Refrigeration system 311 may include system information 304 as detailed in FIG. 1. Refrigeration system 311 may store products within cases 314 included in refrigeration system 311. For example, the products within cases 314 may include foods that are refrigerated or frozen. Control actions 308, including precooling control actions and load shedding control actions, may be determined for refrigeration system 311 by server(s) 102 (and computer components thereof) based on an average power target 302, a time interval 312, and system information 304 received by server(s) 102 (the same as or similar to FIG. 1). Furthermore, a control schedule 310 to effectuate control actions 308 may be determined by server(s) 102 based on average power target 302, time interval 312, building information 306. Control schedule 310 may be subsequently effectuated or may be transmitted to refrigeration system 311 for implementation. As such, power consumption may be optimized for refrigeration system 311 and thus building 150.

Referring back to FIG. 1, in some implementations, server(s) 102, client computing platform(s) 104, and/or external resources 124 may be operatively linked via one or more electronic communication links. For example, such electronic communication links may be established, at least in part, via a network such as the Internet and/or other networks. It will be appreciated that this is not intended to be limiting, and that the scope of this disclosure includes implementations in which server(s) 102, client computing platform(s) 104, and/or external resources 124 may be operatively linked via some other communication media.

A given client computing platform 104 may include one or more processors configured to execute computer program components. The computer program components may be configured to enable an expert or user associated with the given client computing platform 104 to interface with system 100 and/or external resources 124, and/or provide other functionality attributed herein to client computing platform(s) 104. By way of non-limiting example, the given client computing platform 104 may include one or more of a desktop computer, a laptop computer, a handheld computer, a tablet computing platform, a NetBook, a Smartphone, a gaming console, and/or other computing platforms.

External resources 124 may include sources of information outside of system 100, external entities participating with system 100, and/or other resources. In some implementations, some or all of the functionality attributed herein to external resources 124 may be provided by resources included in system 100.

Server(s) 102 may include electronic storage 126, one or more processors 128, and/or other components. Server(s) 102 may include communication lines, or ports to enable the exchange of information with a network and/or other computing platforms. Illustration of server(s) 102 in FIG. 1 is not intended to be limiting. Server(s) 102 may include a plurality of hardware, software, and/or firmware components operating together to provide the functionality attributed herein to server(s) 102. For example, server(s) 102 may be implemented by a cloud of computing platforms operating together as server(s) 102.

Electronic storage 126 may comprise non-transitory storage media that electronically stores information. The electronic storage media of electronic storage 126 may include one or both of system storage that is provided integrally (i.e., substantially non-removable) with server(s) 102 and/or removable storage that is removably connectable to server(s) 102 via, for example, a port (e.g., a USB port, a firewire port, etc.) or a drive (e.g., a disk drive, etc.). Electronic storage 126 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage 126 may include one or more virtual storage resources (e.g., cloud storage, a virtual private network, and/or other virtual storage resources). Electronic storage 126 may store software algorithms, information determined by processor(s) 128, information received from server(s) 102, information received from client computing platform(s) 104, and/or other information that enables server(s) 102 to function as described herein.

Processor(s) 128 may be configured to provide information processing capabilities in server(s) 102. As such, processor(s) 128 may include one or more of a digital processor, an analog processor, a digital circuit designed to process information, an analog circuit designed to process information, a state machine, and/or other mechanisms for electronically processing information. Although processor(s) 128 is shown in FIG. 1 as a single entity, this is for illustrative purposes only. In some implementations, processor(s) 128 may include a plurality of processing units. These processing units may be physically located within the same device, or processor(s) 128 may represent processing functionality of a plurality of devices operating in coordination. Processor(s) 128 may be configured to execute components 108, 110, 112, 114, and/or 118, and/or other components. Processor(s) 128 may be configured to execute components 108, 110, 112, 114, and/or 118, and/or other components by software; hardware; firmware; some combination of software, hardware, and/or firmware; and/or other mechanisms for configuring processing capabilities on processor(s) 128. As used herein, the term "component" may refer to any component or set of components that perform the functionality attributed to the component. This may include one or more physical processors during execution of processor readable instructions, the processor readable instructions, circuitry, hardware, storage media, or any other components.

It should be appreciated that although components 108, 110, 112, 114, and/or 118 are illustrated in FIG. 1 as being implemented within a single processing unit, in implementations in which processor(s) 128 includes multiple processing units, one or more of components 108, 110, 112, 114, and/or 118 may be implemented remotely from the other components. The description of the functionality provided by the different components 108, 110, 112, 114, and/or 118 described below is for illustrative purposes, and is not intended to be limiting, as any of components 108, 110, 112, 114, and/or 118 may provide more or less functionality than is described. For example, one or more of components 108, 110, 112, 114, and/or 118 may be eliminated, and some or all of its functionality may be provided by other ones of components 108, 110, 112, 114, and/or 118. As another example, processor(s) 128 may be configured to execute one or more additional components that may perform some or all of the functionality attributed below to one of components 108, 110, 112, 114, and/or 118.

Figure 2:
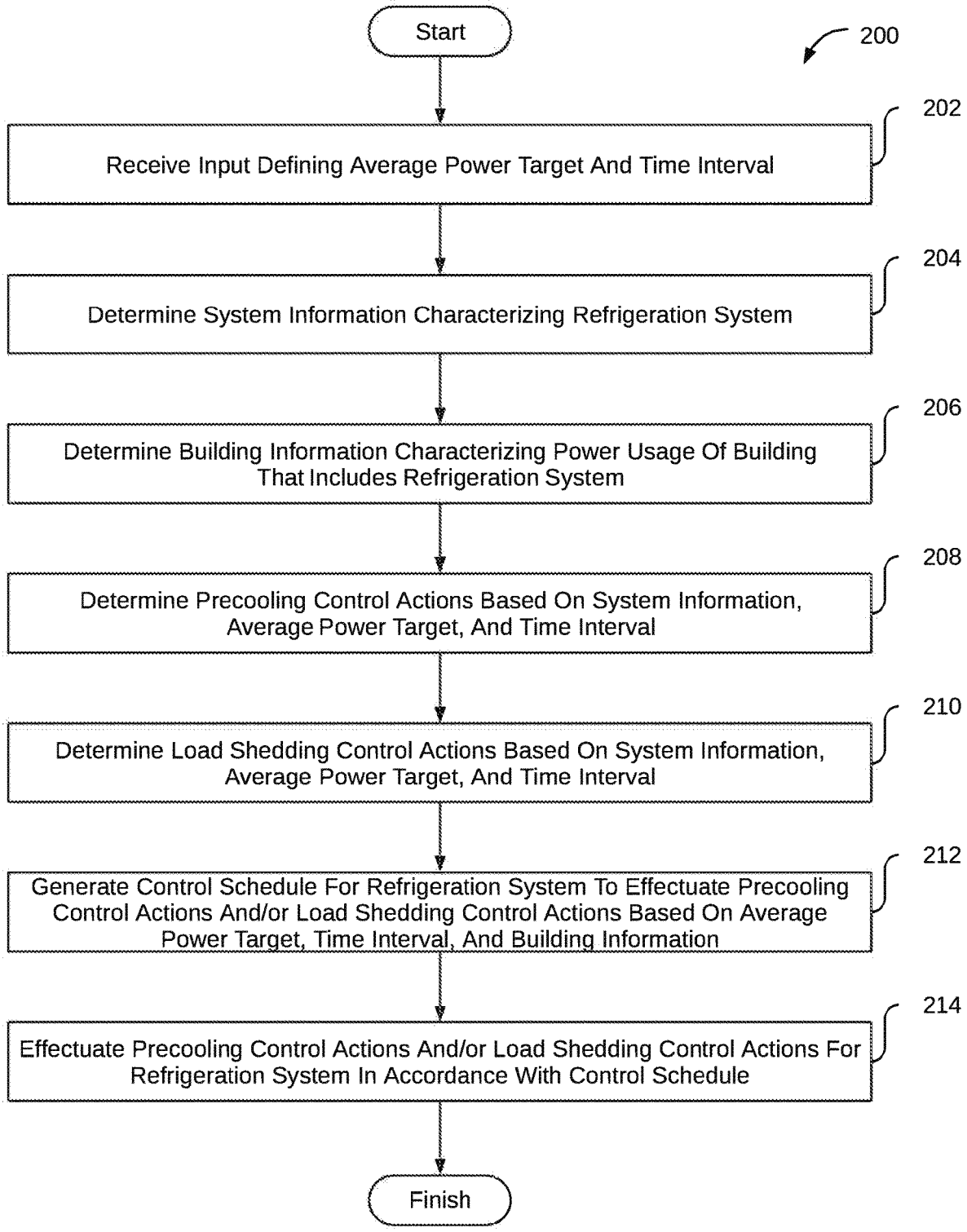
FIG. 2 illustrates a method to manage power consumption of a building and storage by controlling a refrigeration system within the building, in accordance with one or more implementations.

FIG. 2 illustrates a method 200 to manage power consumption of a building and storage by controlling a refrigeration system within building 150, in accordance with one or more implementations. The operations of method 200 presented below are intended to be illustrative. In some implementations, method 200 may be accomplished with one or more additional operations not described, and/or without one or more of the operations discussed. Additionally, the order in which the operations of method 200 are illustrated in FIG. 2 and described below is not intended to be limiting.

In some implementations, method 200 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 200 in response to instructions stored electronically on an electronic storage medium. The one or more processing devices may include one or more devices configured through hardware, firmware, and/or software to be specifically designed for execution of one or more of the operations of method 200.

An operation 202 may include receiving input defining an average power target and a time interval. The average power target may be for the time interval. Operation 202 may be performed by one or more hardware processors configured by machine-readable instructions including a component that is the same as or similar to input receiving component 108, in accordance with one or more implementations.

An operation 204 may include determining system information characterizing a refrigeration system. Operation 204 may be performed by one or more hardware processors configured by machine-readable instructions including a component that is the same as or similar to system information determination component 110, in accordance with one or more implementations.

An operation 206 may include determining building information characterizing power usage of a building that includes the refrigeration system. Operation 206 may be performed by one or more hardware processors configured by machine-readable instructions including a component that is the same as or similar to building information determination component 112, in accordance with one or more implementations.

An operation 208 may include determining precooling control actions based on the system information, the average power target, the time interval, and/or other information. Operation 208 may be performed by one or more hardware processors configured by machine-readable instructions including a component that is the same as or similar to control action determination component 114, in accordance with one or more implementations.

An operation 210 may include determining load shedding control actions based on the system information, the average power target, the time interval, and/or other information. Operation 210 may be performed by one or more hardware processors configured by machine-readable instructions including a component that is the same as or similar to control action determination component 114, in accordance with one or more implementations.

An operation 212 may include generating a control schedule for the refrigeration system to effectuate the precooling control actions and/or load shedding control actions based on the average power target, the time interval, the building information, and/or other information. The precooling may control actions and load shedding control actions facilitate acquisition of electrical power or distribution of the electrical power. Operation 212 may be performed by one or more hardware processors configured by machine-readable instructions including a component that is the same as or similar to control component 118, in accordance with one or more implementations.

An operation 214 may include effectuating the precooling control actions and/or load shedding control actions for the refrigeration system in accordance with the control schedule. Operation 214 may be performed by one or more hardware processors configured by machine-readable instructions including a component that is the same as or similar to control component 118, in accordance with one or more implementations.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system configured to manage power consumption of a building and storage by controlling a refrigeration system within the building, the system comprising:

one or more processors, configured by machine-readable instructions, that are capable of controlling the refrigeration system, wherein the controlling of the refrigeration system includes activating one or more compressors, deactivating unloaders, increasing frequency of variable frequency drives for active ones of the one or more compressors, and controlling circuit control valves connected to one or more evaporators, the machine-readable instructions configuring the one or more processors to:

receive input defining a power target and a time interval, wherein the power target is for the time interval;

determine system information characterizing the refrigeration system, wherein the refrigeration system includes one or more cases, the one or more compressors, and the one or more evaporators, wherein the one or more cases cool, maintain coldness, freeze, or keep frozen food products and store the food products;

determine power usage of the building that includes the refrigeration system by calculating an amount of energy the building consumes per unit of time based on a regression model, a time of a day, the day of a week, an occupancy value, and an outside air temperature value;

determine precooling control actions based on the system information, the power target, and the time interval, wherein the precooling control actions include one or more of activating the one or more compressors, deactivating the unloaders, increasing frequency of the variable frequency drives for the compressors that are active, and controlling circuit control valves connected to the one or more evaporators;

determine load shedding control actions based on the system information, the power target, and the time interval;

generate a control schedule for the refrigeration system to effectuate the precooling control actions and/or load shedding control actions based on the power target, the time interval, and the power usage, wherein the precooling control actions and load shedding control actions facilitate acquisition of electrical power or distribution of the electrical power; and effectuate the precooling control actions and/or load shedding control actions for the refrigeration system in accordance with the control schedule.

2. The system of claim 1, wherein generating the control schedule is based on a required power target and/or a building temperature, wherein the required power target is power required by the building to operate.

3. The system of claim 2, wherein the regression model is based on historical facility operations, wherein the system information includes the historical facility operations.

4. The system of claim 1, wherein the system information includes suction pressures, compressor information, case information, circuit control information, defrost schedules, door information, and/or pressure information.

5. The system of claim 1, wherein the load shedding control actions include deactivating some of the compressors, activating unloaders, and/or decreasing frequency of variable frequency drives for the compressors that are active.

6. A method to manage power consumption of a building and storage by controlling a refrigeration system within the building via one or more processors, configured by machine-readable instructions, that are capable of controlling the refrigeration system, wherein the controlling of the refrigeration system includes activating one or more compressors, deactivating unloaders, increasing frequency of variable frequency drives for active ones of the one or more compressors, and controlling circuit control valves connected to one or more evaporators, the method comprising:

receiving, by the one or more processors, input defining a power target and a time interval, wherein the power target is for the time interval;

determining, by the one or more processors, system information characterizing the refrigeration system, wherein the refrigeration system includes one or more cases, the one or more compressors, and the one or more evaporators, wherein the one or more cases cool, maintain coldness, freeze, or keep frozen food products and store the food products;

determining, by the one or more processors, power usage of the building that includes the refrigeration system by calculating an amount of energy the building consumes per unit of time based on a regression model, a time of a day, the day of a week, an occupancy value, and an outside air temperature value;

determining, by the one or more processors, precooling control actions based on the system information, the power target, and the time interval, wherein the precooling control actions include one or more of activating the one or more compressors, deactivating the unloaders, increasing frequency of the variable frequency drives for the compressors that are active, and controlling circuit control valves connected to the one or more evaporators;

determining, by the one or more processors, load shedding control actions based on the system information, the power target, and the time interval;

generating, by the one or more processors, a control schedule for the refrigeration system to effectuate the precooling control actions and/or load shedding control actions based on the power target, the time interval, and the power usage, wherein the precooling control actions and load shedding control actions facilitate acquisition of electrical power or distribution of the electrical power; and effectuating, by the one or more processors, the precooling control actions and/or load shedding control actions for the refrigeration system in accordance with the control schedule.

7. The method of claim 6, wherein generating the control schedule is based on a required power target and/or a building temperature, wherein the required power target is power required by the building to operate.

8. The method of claim 7, wherein the regression model is based on historical facility operations, wherein the system information includes the historical facility operations.

9. The method of claim 6, wherein the system information includes suction pressures, compressor information, case information, circuit control information, defrost schedules, door information, and/or pressure information.

10. The method of claim 6, wherein the load shedding control actions include deactivating some of the compressors, activating unloaders, and/or decreasing frequency of variable frequency drives for the compressors that are active.

* * * * *